US005236382A

United States Patent [19]

Oh

[11] Patent Number: 5,236,382

[45] Date of Patent: Aug. 17, 1993

[54] METHOD FOR MANUFACTURING AN IMPREGNATED CATHODE STRUCTURE

[75] Inventor: Jong-ho Oh, Suwon, Rep. of Korea

[73] Assignee: Samsung Electron Devices Co., Ltd., Kyungki-do, Rep. of Korea

[21] Appl. No.: 936,783

[22] Filed: Aug. 28, 1992

[30] Foreign Application Priority Data

Oct. 24, 1991 [KR] Rep. of Korea ..... 91-18769

[51] Int. Cl.[5] ..... H01J 9/04

[52] U.S. Cl. ..... 445/50; 445/59

[58] Field of Search ..... 445/50, 51, 59

[56] References Cited

U.S. PATENT DOCUMENTS 4,833,361 5/1989 Suzuki et al. ..... 313/346 DC X

*Primary Examiner*—Kenneth J. Ramsey

*Attorney, Agent, or Firm*—Leydig, Voit & Mayer

[57] ABSTRACT

In a method for manufacturing an impregnated cathode structure, cleaning water under high pressure is sprayed onto a pellet with an impregnated cathode material, thereby eliminating residue adhering on the surface of the pellet. By spraying high-pressure cleaning water, a physical force is applied to only the surface of the pellet, thereby dissolving almost all the residue on the surface of the pellet, as well as portions of an electron emitting material. Thus, the electron emitting material existing adjacent to the surface does not become grown over the surface of the pellet during the partial degeneration thereof, and does not cover or damage a metal covering layer composed of at least any one of Ir, Os, Ru, Re, Sc, etc., and formed on the surface of the pellet.

2 Claims, 2 Drawing Sheets

METHOD FOR MANUFACTURING AN IMPREGNATED CATHODE STRUCTURE

BACKGROUND OF THE INVENTION

The present invention relates to a method for manufacturing a dispenser cathode structure, and more particularly to a method for manufacturing a dispenser cathode structure wherein a porous pellet is impregnated with thermoelectron-emitting material.

Generally, dispenser cathodes are classified into a cavity reservoir type, an impregnated type, and a sintered type according to their structure. A common characteristic of these is that, since their beam current density can be heightened, they are suitable for a full-sized Braun or projecting tube, and especially, are very durable.

FIG. 1 is a sectional view showing one example of a conventional impregnated-type dispenser cathode structure. This cathode structure includes a porous pellet 2 formed of a refractory metal selected from a group consisting of tungsten, molybdenum, etc., sintered with an electron emitting material, a reservoir 3 for accommodating pellets 2, and a sleeve 4 which includes a heater 4*a* and supports reservoir 3. A metal covering layer 5 formed of at least any one of Ir, Os, Ru, Sc, etc., is provided on the surface of pellets 2 supported by reservoir 4. This metal covering layer 5 forms an alloy in conjunction with a metal on the surface of pellet 2.

A method for manufacturing impregnated cathode structure 1 formed as above is described below. 1. A metal powder such as molybdenum, tungsten, etc., is press-molded into a predetermined shape, and fired to produce pellets 2 which are then inserted into cup-shaped reservoir 3 formed of a heat-resistant material, thereby welding them to each other.

2. Electron emitting material 2*a* composed of mixed BaO, CaO, and $Al_2O_3$ is melted and impregnated into pellets 2 within a vacuum heating furnace at 1500°-1700° C. or a heating furnace in a hydrogen gas ambient.

3. Residue 2*a'* having adhered to the surfaces of pellet 2 and reservoir 3 during the impregnating process, are eliminated by an abrasive polishing of those surfaces.

4. Metal covering layer 5 composed of at least any one of Ir, Os, Ru, Sc, etc., is formed on the surface of pellets 2 by a sputtering method.

5. Reservoir 3 is inserted into the upper portion of separately formed cylindrical sleeve 4, followed by welding them to each other.

6. Finally, a heater is housed in the sleeve, during its assembly into an electron gun.

In the method for manufacturing the conventional impregnated cathode as described above, fine sandpaper is utilized in the process for eliminating the residue of the impregnation having adhered to the surface of pellets 2 and reservoir 3. Under certain circumstances, grit-blasting is employed, wherein hard, minute particles such as $Al_2O_3$ powder and the like are sprayed at high speed at the residue adherent to pellets 2 and reservoir 3, so that the residue is eliminated by the impact of the minute particles. In the abrasion method using the sandpaper or grit-blasting, the surface of pellets 2 gets stripped off or becomes deformed, so that the pores are partially clogged as shown in FIG. 2B, which impedes the diffusion of the cathode material over the surface of the pellet. Moreover, due to inconsistent abrading, the residue of the impregnation remains on portions of the surface of pellet 2.

FIG. 3 illustrates the measurement of the surface of a pellet having the residue eliminated using the above-described conventional techniques, by electro-probe microanalysis (EPMA). Here, the highest peak indicates the presence of tungsten, and the two smaller peaks show the presence of calcium and barium. Like this, the electron emitting materials remaining on the pellet produce other impurities by reacting with $CO_2$, $H_2O$, and the like which are included in air. Especially, the electron emitting material expands in size by reacting with the $H_2O$, thereby partially covering or damaging metal covering layer 5 on the surface of the pellet. In addition, according to such abrasive polishing methods, other impurities are introduced from the sandpaper or abrasive particles during the elimination of the residue of impregnation, which may cause more serious problems.

On the other hand, in order to solve the problems with the abrasive polishing methods, ultrasonic waves are applied to a clearing water in which the pellet impregnated with the cathode materials is soaked, so that the impregnated residue on the surface of the pellet is eliminated by ultrasonic vibrations of the cleaning water (refer to U.S. Pat. No. 4,417,173 and Applications of Surface Science 8, pp. 13-35, North-Holland Publishing Company, 1981). However, according to this ultrasonic cleansing method, not only the unnecessary residue adherent on the pellet is eliminated but also a certain amount of cathode material present in the inner cavities of the pellet. Such loss of cathode material serves to reduce the cathode's ability to emit thermoelectrons.

SUMMARY OF THE INVENTION

The present invention is submitted to solve the above-described problems. Accordingly, it is an object of the present invention to provide a method for manufacturing an impregnated cathode structure, which can effectively eliminate impregnated residue from a pellet of a cathode structure impregnated with electron emitting material, without damaging the surface of the pellet.

It is another object of the present invention to provide a method for manufacturing an impregnated cathode structure, wherein high current density can be obtained by stabilizing a metal covering layer formed on the surface of a pellet of a cathode structure, and the difficult maintenance of the pellet during manufacturing processes is solved.

To achieve the above objects of the present invention, there is provided a method for manufacturing an impregnated cathode structure comprising the steps of:

forming a porous pellet with a refractory metal powder;

melting a cathode material and impregnating the pellet with the melted cathode material;

eliminating unnecessary residue adherent to the surface of the pellet by spraying cleaning water under high pressure onto the surface of the pellet;

fixing the pellet to a cup-shaped reservoir by welding; and fixing the reservoir in the upper portion of a cylindrical sleeve by welding.

Also, according to another aspect of the present invention, there is provided a method for manufacturing an impregnated cathode structure comprising:

forming a porous pellet with a refractory metal powder;

fixing the porous pellet to a cup-shaped reservoir composed of a material having a high-melting point;

melting a cathode material and impregnating the porous pellet fixed to the reservoir, with the melted cathode material;

eliminating unnecessary residue adherent to the surface of the pellet and reservoir by spraying cleaning water under high pressure onto the surfaces of the pellet and reservoir; and fixing the reservoir in the upper portion of a cylindrical sleeve by welding.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
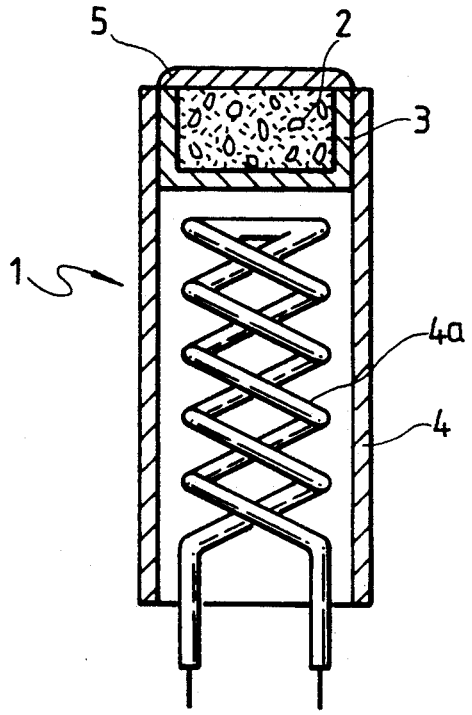
FIG.1(PRIOR ART)
FIG. 1 is an elevational sectional view showing a general impregnated cathode structure.
Figure 2A:
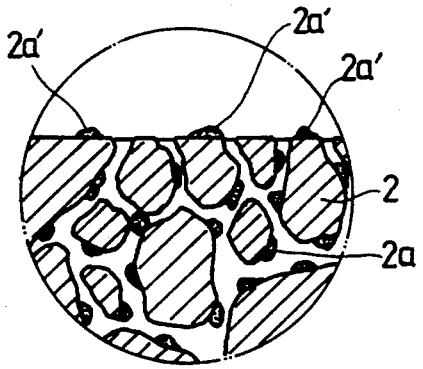
FIG.2A(PRIOR ART)
FIG. 2A is an enlarged sectional view showing the surface of a pellet of the impregnated cathode structure with residue thereon.
Figure 2B:
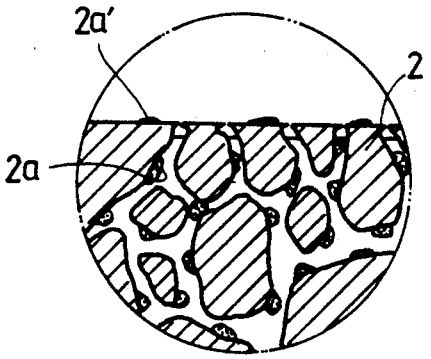
FIG.2B(PRIOR ART)
FIG. 2B is an enlarged sectional view showing the surface of a pellet of the impregnated cathode structure, wherein impregnated residue has been eliminated via conventional techniques using sandpaper or grit-blasting.
Figure 3:
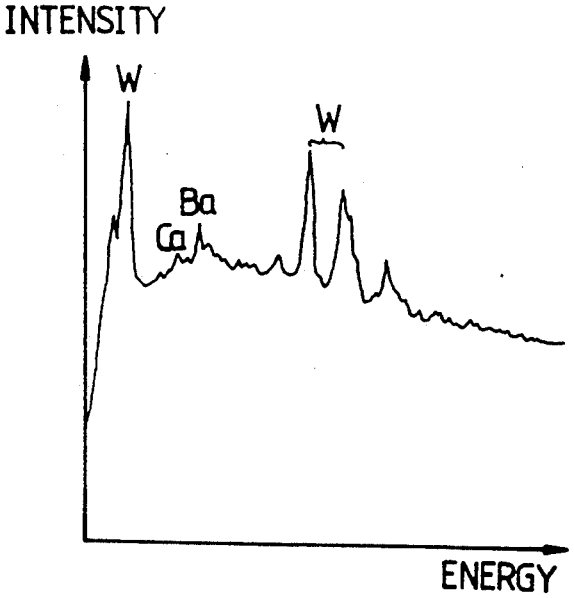
FIG.3(PRIOR ART)
FIG. 3 represents a characteristic graph showing the results of measurement by EPMA of the pellet's surface of an impregnated cathode structure which has been subjected to conventional cleansing processes.

A preferred embodiment of the present invention will be described with reference to FIG. 1 which illustrates a general impregnated cathode structure.

EMBODIMENT 1

Step 1: at least any one of metal powders such as molybdenum, tungsten, etc., is press-molded to form a cylindrical metal rod having a predetermined length, which is then fired.

Step 2: the base metal is cut to have a disc shape to obtain a desired porous pellet 2.

Step 3: an electron emitting material composed of a mixture of BaO, CaO and $Al_2O_3$ is melted and impregnated into pellet 2, within a vacuum furnace at 1500°-1700° C. or higher or in a hydrogen filled heating furnace.

Step 4: cleaning water under high pressure is sprayed on the surfaces of pellets 2 and a reservoir 3 during the impregnating process, so that impregnated residue adherent to the pellets and reservoir is eliminated by melting.

Step 5: pellets 2 are inserted into the cup-shaped reservoir 3 composed of a heat-resistant material, and they are welded together.

Step 6: a metal covering layer 5 is formed on the surface of pellets 2 by melting and spraying at least a metal of Ir, Os, Ru, Sc, etc., via a plasma melting/spraying or sputtering method.

Step 7: reservoir 3 is inserted into the upper portion of a separately formed cylindrical sleeve 4 composed of refractory metal, thereby welding them together.

EMBODIMENT 2

Step 1: at least any one of metal powders such as molybdenum, tungsten, etc., is press-molded to form a cylindrical metal rod having a predetermined length, which is then fired.

Step 2: the base metal is cut to have a disc shape to obtain a desired porous pellet 2.

Step 3: pellets 2 are inserted into a cup-shaped reservoir 3 composed of a heat-resistant material, and they are welded together.

Step 4: an electron emitting material composed of a mixture of BaO, CaO and $Al_2O_3$ is melted to therewith impregnate pellet 2, within a vacuum furnace at 1500°-1700° C. or higher or in a hydrogen filled heating furnace.

Step 5: cleaning water under high pressure is sprayed on the surfaces of pellets 2 and reservoir 3 during the impregnating process, so that impregnated residue adherent to the pellet and reservoir is eliminated by melting.

Step 6: a metal covering layer 5 is formed on the surface of pellet 2 by melting and spraying at least any one metal of Ir, Os, Ru, Sc, etc., via a plasma melting/spraying or sputtering method.

Step 7: reservoir 3 is inserted into the upper portion of a separately formed cylindrical sleeve 4 composed of a refractory metal, followed by welding them together.

Figure 4A:
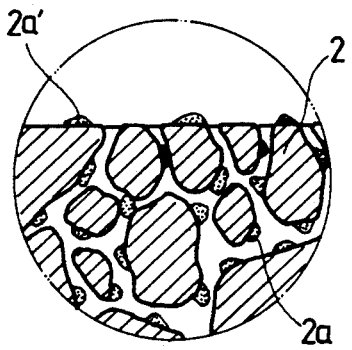
FIG. 4A is an enlarged view showing the surface of the pellet of the impregnated cathode structure with residue thereon (as shown in FIG. 2A)
Figure 4B:
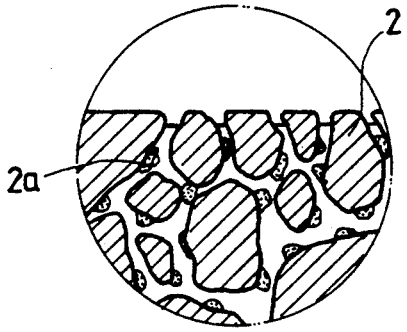
FIG. 4B is an enlarged view showing the surface of the pellet of the impregnated cathode structure, wherein impregnated residue has been eliminated by a method for manufacturing an impregnated cathode structure according to the present invention.
Figure 5:
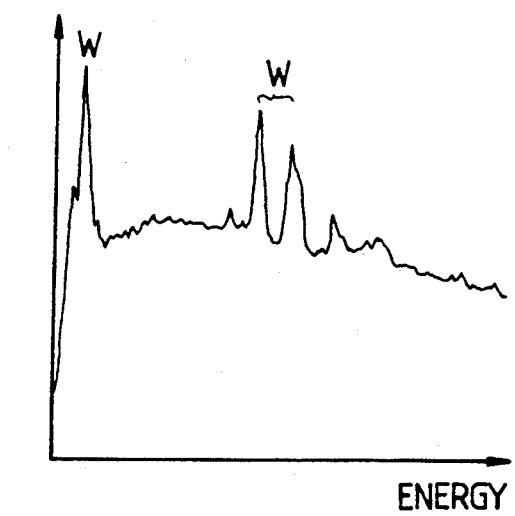
FIG. 5 represents a characteristic graph showing the results of measurement by EPMA of the pellet's surface of an impregnated cathode structure which has been cleansed via a cleansing method according to the present invention.

A characteristic of the above-described present invention is that cleaning water ($H_2O$) is sprayed with high-pressure, on the order of about 1 to about 20 kgf/cm$^2$ and at a temperature of about 5° to about 100° C., onto impregnated residue 2*a'* adherent to the surface of pellet 2 impregnated with the electron emitting material as shown in FIG. 4A, so that the impregnated residue is completely eliminated from the surface of pellet 2 as shown in FIG. 4B. In other words, as the residual particles swell after contact with the cleaning water, the impregnated residue attached to the surface of the pellet is eliminated by impact (i.e., a physical force) of the cleaning water sprayed with high pressure. FIG. 5 represents a characteristic graph measured by EPMA, reflecting the surface conditions of a pellet of the impregnated cathode structure formed by the present invention, and shows that only tungsten is present.

The result of the manufacturing method according to the present invention is compared with that of the conventional ultrasonic cleaning method. In more detail, according to the ultrasonic cleaning, not only is the residue on the surface of pellet dissolved, but also some of the necessary electron emitting material deeply impregnated into the body of pellet, causing excessive loss of the electron emitting material. Meanwhile, according to the present invention, since a physical force is applied to just the surface of pellet by spraying pressured cleaning water, almost all residue on the surface of pellet are eliminated. Also, the physical force is not applied to the cavities within the body of pellet, but the cleaning water does penetrate somewhat, so portions of the electron emitting material near to the surface of the pellet are dissolved. This partial melting of the electron emitting material adjacent to the surface of pellet is necessary, however, because of the degeneration of the electron emitting material present in the cavities adjacent to the surface. Thus, in this case, the degeneration of electron emitting material does not cause growth beyond the pellet's surface. Accordingly, metal covering layer 5 on the surface of pellet 2, which is composed of Ir, Os, Ru, Re, Sc, etc., does not become partly covered or damaged by the growth of electron emitting material 2*a* due to the degeneration.

In order to measure the characteristics of the cathode structure according to the present invention, after impregnating a 20%-porous pellet with the electron emitting material, respective specimens are produced by the conventional methods (i.e., the methods for eliminating the residue using sandpaper or grit-blasting), and the method according to the present invention. Particles of $Al_2O_3$ whose average diameter is 10 μm are sprayed with a force of 2 kgf/cm$^2$ during grit-blasting, while $H_2O$ is separately sprayed thereon, preferably also with a force of 2 kgf/cm$^2$. In the present invention, air, $N_2$ or Ar etc., are adopted as gases for pressurizing the cleaning water and forcing it out of the nozzle, and an inert gas such as $N_2$ or Ar is preferably adopted to suppress degeneration of the electron emitting material.

Figure 6:
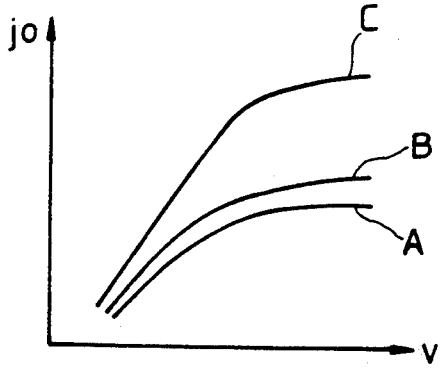
FIG. 6 is a comparative graph representing the respective current densities of cathodes, when the impregnated residue on the pellet's surface of the impregnated cathode structure is eliminated by the conventional methods and the method according to the present invention.

FIG. 6 shows comparative current density characteristics of the specimens produced as above. Here, it can be noted that the current density (C in the drawing) of the pellet's surface of the cathode structure wherefrom the impregnated residue is eliminated by high-pressure spraying of water, is higher than those using sandpaper (A) and grit-blasting (B). This manifests the fact that, the metal covering layer of the impregnated cathode structure according to the present invention is not covered or damaged by degeneration of the electron emitting material on the surface of the cathode structure caused during eliminating the impregnated residue attached to the pellet, so that the work function of the surface is lowered.

It will be apparent that many modifications and variations could be effected easily by one skilled in the art without departing from the spirit or scope of the novel concepts of the present invention.

What is claimed is:

1. A method for manufacturing an impregnated cathode structure comprising the steps of:

forming a porous pellet with refractory metal powder;

melting a cathode material to therewith impregnate said pellet;

eliminating unnecessary residue adherent to the surface of said pellet by spraying cleaning water under high pressure onto the surface of said pellet;

fixing said pellet to a cup-shaped reservoir by welding; and fixing said reservoir in the upper portion of a cylindrical sleeve by welding.

2. A method for manufacturing an impregnated cathode structure comprising:

forming a porous pellet with a refractory metal powder;

fixing said porous pellet to a cup-shaped reservoir composed of a material having a high-melting point;

melting a cathode material and impregnating said porous pellet fixed to said reservoir with said melted cathode material;

eliminating unnecessary residue adherent to the surface of said pellet and reservoir by spraying cleaning water under high pressure onto the surfaces of said pellet and reservoir; and fixing said reservoir in the upper portion of a cylindrical sleeve by welding.

* * * * *